US010920333B2

(12) United States Patent
Curran et al.

(10) Patent No.: US 10,920,333 B2
(45) Date of Patent: Feb. 16, 2021

(54) PROCESS FOR PRODUCING WHITE ANODIC OXIDE FINISH

(71) Applicant: Apple Inc., Cupertino, CA (US)

(72) Inventors: James A. Curran, Morgan Hill, CA (US); Daniel T. McDonald, San Jose, CA (US); Sean R. Novak, San Jose, CA (US)

(73) Assignee: APPLE INC., Cupertino, CA (US)

( * ) Notice: Subject to any disclaimer, the term of this patent is extended or adjusted under 35 U.S.C. 154(b) by 180 days.

(21) Appl. No.: 15/418,235

(22) Filed: Jan. 27, 2017

(65) Prior Publication Data

US 2017/0226651 A1 Aug. 10, 2017

Related U.S. Application Data

(60) Provisional application No. 62/292,173, filed on Feb. 5, 2016.

(51) Int. Cl.
*C25D 11/24* (2006.01)
*C25D 11/26* (2006.01)
(Continued)

(52) U.S. Cl.
CPC ..... *C25D 11/246* (2013.01); *C25D 11/08* (2013.01); *C25D 11/24* (2013.01); *C25D 11/26* (2013.01);
(Continued)

(58) Field of Classification Search
CPC ..... C25D 11/14
See application file for complete search history.

(56) References Cited

U.S. PATENT DOCUMENTS 9,051,658 B2 6/2015 Tatebe et al.
9,416,461 B2 8/2016 Minari et al.
(Continued)

FOREIGN PATENT DOCUMENTS

CN 103029247 A 4/2013
CN 102575373 B 5/2014
(Continued)

OTHER PUBLICATIONS

Benjamin, Modern Mechanism, 1904, p. 30.*
(Continued)

*Primary Examiner* — Mark Ruthkosky
*Assistant Examiner* — Julia L Rummel
(74) *Attorney, Agent, or Firm* — Dorsey & Whitney LLP

(57) ABSTRACT

The embodiments described herein relate to treatments for anodic layers. The methods described can be used to impart a white appearance for an anodized substrate. The anodized substrate can include a metal substrate and a porous anodic layer derived from the metal substrate. The porous anodic layer can include pores defined by pore walls and fissures formed within the pore walls. The fissures can act as a light scattering medium to diffusely reflect visible light. In some embodiments, the method can include forming fissures within the pore walls of the porous anodic layer. In some embodiments, exposing the porous anodic layer to an etching solution can form fissures. The method further includes removing a top portion of the porous anodic layer while retaining a portion of the porous anodic layer.

19 Claims, 9 Drawing Sheets

(51) Int. Cl.

| | |
|---|---|
| ***C25D 11/08*** | (2006.01) |
| *C25D 11/14* | (2006.01) |
| *C25D 11/16* | (2006.01) |

(52) U.S. Cl.

CPC ..... *C25D 11/14* (2013.01); *C25D 11/16* (2013.01); *Y10T 428/249978* (2015.04); *Y10T 428/249986* (2015.04)

(56) References Cited

U.S. PATENT DOCUMENTS

| | | | | |
|---|---|---|---|---|
| 9,512,536 | B2 | 12/2016 | Tatebe et al. | |
| 2011/0214993 | A1* | 9/2011 | Akana | C25D 5/00 205/50 |
| 2014/0076600 | A1* | 3/2014 | Browning | C23C 28/04 174/50 |
| 2014/0193607 | A1 | 7/2014 | Browning et al. | |
| 2015/0090597 | A1 | 4/2015 | Tatebe et al. | |
| 2017/0016136 | A1 | 1/2017 | Yamamoto et al. | |

FOREIGN PATENT DOCUMENTS

| | | | |
|---|---|---|---|
| CN | 103938250 | A | 7/2014 |
| CN | 105129723 | A | 12/2015 |
| EP | 2575145 | A1 | 4/2013 |
| JP | 49016636 | A * | 2/1974 |
| WO | 2015047634 | A1 | 4/2015 |
| WO | 2015047635 | A1 | 4/2015 |
| WO | 2015129663 | A1 | 9/2015 |

OTHER PUBLICATIONS

"Alumina" entry in Britannica Online Encyclopedia (http://www.britannica.com/EBchecked/topic/17897/alumina), p. 1-2; Accessed on Oct. 26, 2018.*

English language translation of JP 49-16636A generated on Mar. 31, 2020 with J-Plat Pat Website https://www.j-platpat.inpit.go.jp/.*

German Utility Model Application No. 20 2017 000 426.7—Search Report dated Sep. 8, 2017. (Machine English Translation).

Chinese Patent for Utility Model No. ZL201720107344.1—Evaluation Report (UMPER) dated Dec. 12, 2017.

Chinese Patent for Utility Model No. ZL201720107344.1—Notification of Review Opinions on Patentability Evaluation Report and Corrected Evaluation Report (UMPER) dated Apr. 3, 2018.

"Aluminum Alloy Response to Anodizing", AaCron Anodizing, AaCron, Inc., Minneapolis, MN, 1 page. http://www.aacron.com/docs/Aluminum%20Alloy%20Response%20to%20Anodizing%20rev%20C.pdf.

* cited by examiner

PROCESS FOR PRODUCING WHITE ANODIC OXIDE FINISH

CROSS-REFERENCE TO RELATED APPLICATION

The present application claims the benefit of U.S. Provisional Application No. 62/292,173, entitled "PROCESS FOR PRODUCING WHITE ANODIC OXIDE FINISH" filed on Feb. 5, 2016, the contents of which are incorporated by reference in its entirety for all purposes.

FIELD

The described embodiments relate to anodic layers and methods for forming anodic layers. More specifically, white appearing anodic layers and methods for providing a white appearance to anodic layers are described.

BACKGROUND

Anodizing is an electrochemical process that thickens a naturally occurring protective oxide on a metal surface. An anodizing process involves converting part of a metal surface to an anodic layer. Thus, an anodic layer becomes an integral part of the metal surface. Due to its chemical inertness and hardness, an anodic layer can provide corrosion resistance and wear protection for an underlying metal. In addition, an anodic layer can enhance a cosmetic appearance of the metal surface. For example, the anodic layer can have a porous microstructure that can be infused with dyes to impart a desired color to the anodic layer.

Conventional methods for coloring anodic layers include dyeing the anodic layers. These techniques take advantage of the porous microstructures of anodic layers in that the pores that are formed within the anodic layers during the anodizing process can be infused with dyes and subsequently sealed. These techniques, however, have not been able to achieve an anodic layer with a white appearance as conventional white colorants (pigments) are generally relatively large compared to other types of dyes, and are therefore difficult to infuse within the pores of anodic layers.

SUMMARY

This paper describes various embodiments related to coloring anodized substrates. The anodized substrates can be characterized as having a visibly white appearance.

According to one embodiment, a method for forming an anodized substrate having a white appearance is described. The method includes forming fissures within pore walls of a porous anodic layer, the pore walls defining pores that are arranged within the porous anodic layer. The method further includes removing an outer portion of the porous anodic layer such that a remaining portion of the porous anodic layer includes at least some of the fissures.

According to another embodiment, a method for providing a white appearance to an anodized substrate, is described. The anodized substrate includes a porous anodic layer derived from a metal substrate, the porous anodic layer including pores defined by pore walls. The method includes exposing the porous anodic layer to an etching solution such that fissures form within the pore walls of the porous anodic layer and removing an outer portion of the porous anodic layer such that a remaining portion of the porous anodic layer includes at least some of the fissures.

According to yet another embodiment, an anodized substrate having a white appearance is described. The anodized substrate includes a metal substrate and a porous anodic layer that includes pores defined by pore walls, where the fissures are formed within the pore walls.

The described embodiments may be better understood by reference to the following description and the accompanying drawings. Additionally, advantages of the described embodiments may be better understood by reference to the following description and accompanying drawings.

BRIEF DESCRIPTION OF THE DRAWINGS

The included drawings are for illustrative purposes and serve only to provide examples of possible structures and arrangements for the disclosed inventive apparatuses and methods for their application to computing devices. These drawings in no way limit any changes in form and detail that can be made to the embodiments by one skilled in the art without departing from the spirit and scope of the embodiments. The embodiments will be readily understood by the following detailed description in conjunction with the accompanying drawings, wherein like reference numerals designate like structural elements.

DETAILED DESCRIPTION

The following disclosure describes various embodiments of anodized surfaces and methods for forming anodized surfaces. Certain details are set forth in the following description and figures to provide a thorough understanding of various embodiments of the present technology. Moreover, various features, structures, and/or characteristics of the present technology can be combined in other suitable structures and environments. In other instances, well-known structures, materials, operations, and/or systems are not shown or described in detail in the following disclosure to avoid unnecessarily obscuring the description of the various embodiments of the technology. Those of ordinary skill in the art will recognize, however, that the present technology can be practiced without one or more of the details set forth herein, or with other structures, methods, components, and so forth.

This application describes anodized layers that are white in appearance and methods for forming such anodized layers. In general, white is the color or the appearance of objects that diffusely reflect all visible wavelengths of light incident on the object. Methods described herein provide internal surfaces within the anodized layer that can diffusely reflect substantially all wavelengths of visible light incident on the anodized layer, thereby imparting a white appearance to the anodized layer. The anodized layer can act as a protective layer in that it can provide corrosion resistance and surface hardness for the underlying substrate. The white anodized layer is well suited for providing a protective and attractive surface to visible portions of a consumer product. For example, the anodized layer and methods described herein can be used for providing protective and cosmetically appealing exterior portions of metal enclosures and casings for electronic devices.

One technique for forming an anodized layer having a white appearance involves an approach where the porous microstructures of the anodized layer are modified to form fissures within the porous microstructure. This technique involves forming fissures formed within walls of the pores. The fissures formed within the walls of the pores can scatter or diffuse incident visible light coming from a top surface of the substrate, giving the anodized layer a white appearance as viewed from the top surface of the substrate.

As used herein, the terms anodic film, anodized film, anodic layer, anodized layer, anodic layer, anodic oxidized layer, oxide film, oxidized layer, and oxide layer are used interchangeably and refer to any appropriate oxide layers. The anodic layers are formed on metal surfaces of a metal substrate. The metal substrate can include any of a number of suitable metals. In some embodiments, the metal substrate includes pure aluminum or aluminum alloy. In some embodiments, suitable aluminum alloys include 1000, 2000, 5000, 6000, and 7000 series aluminum alloys.

Figure 1A:
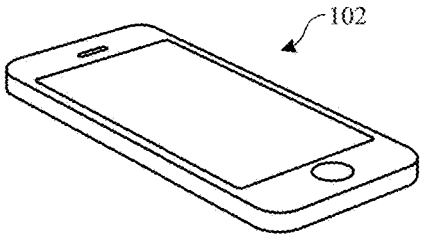
FIGS. 1A-1D illustrate perspective views of various devices having metallic surfaces that can be protected using the anodic oxide coatings described herein.
Figure 1B:
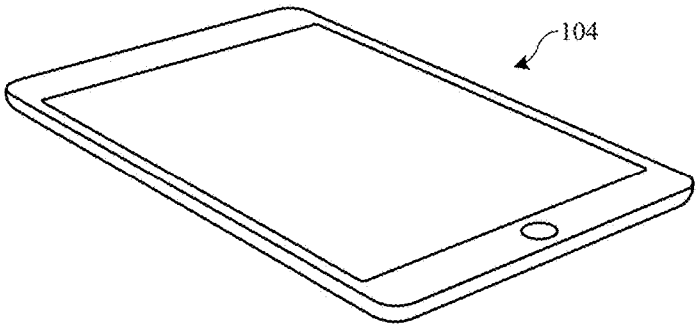
Figure 1C:
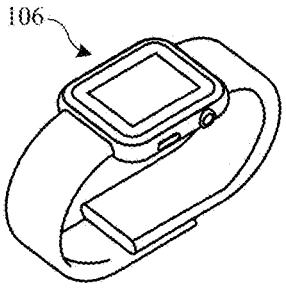
Figure 1D:
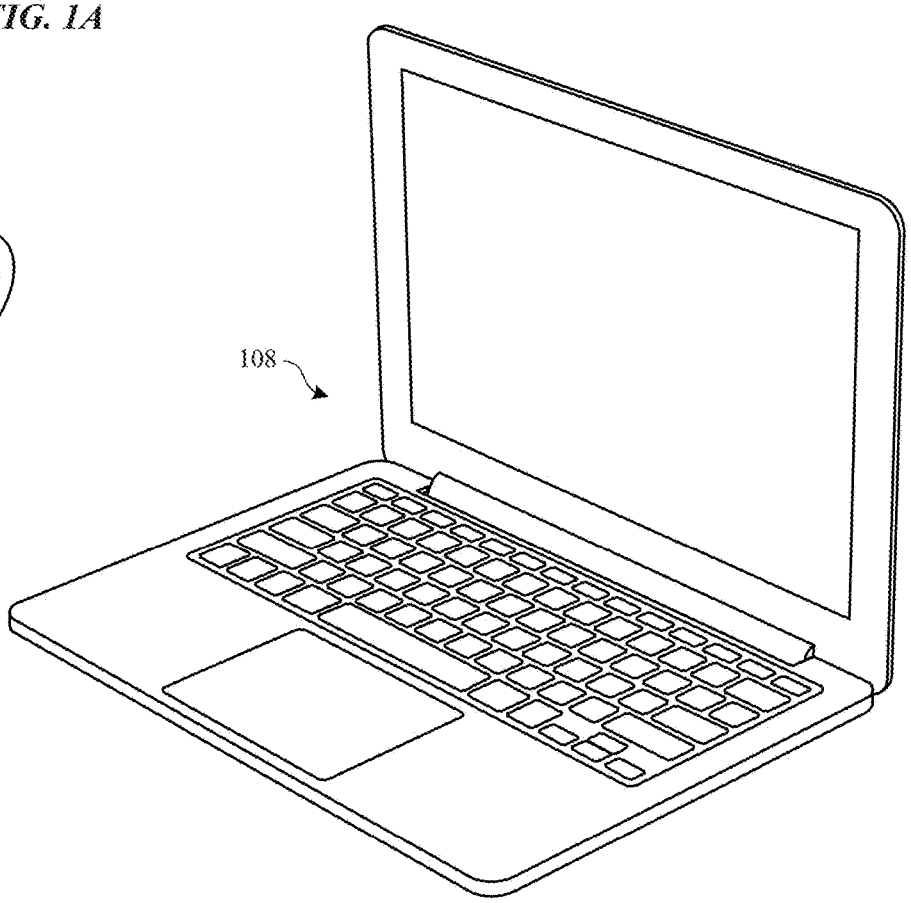

The methods described herein can be used to form durable and cosmetically appealing coatings for metallic surfaces of consumer devices. FIGS. 1A-1D show consumer products that can be manufactured using methods described herein. Each of the products shown in FIGS. 1A-1D include housings that are made of metal or have metal sections. FIG. 1A illustrates a portable phone 102. FIG. 1B illustrates a tablet computer 104. FIG. 1C illustrates a smart watch 106. FIG. 1D illustrates a portable computer 108.

Aluminum alloys are often a choice metal material due to their light weight and ability to anodize and form a protective anodic oxide coating that protects the metal surfaces from scratches. The anodic oxide coatings can be colorized to impart a desired color to the metal housing or metal sections, thereby adding numerous cosmetic options for product lines.

Conventional anodic oxide coloring techniques involve infusing dyes, such as organic dyes, within the pores of the anodic oxide. It is difficult, however, to create an anodic oxide finish that has a white color since white pigments particles are relatively large and difficult to adequately incorporate within an anodic oxide. Described herein are coloring techniques that can provide anodic oxide finishes to metal substrate, such as those on housing of devices 102, 104, 106 and 108, having a white appearance.

Figure 2A:
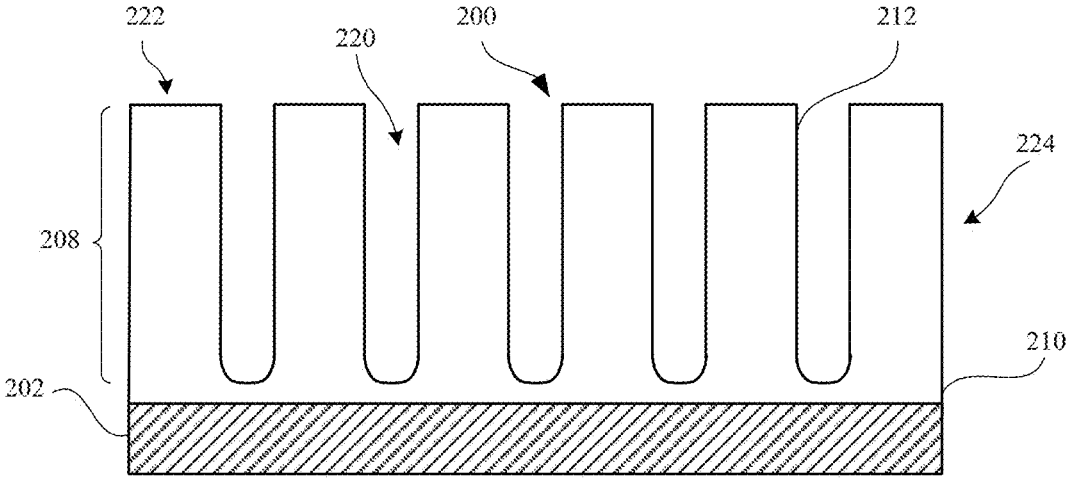
FIGS. 2A-2C illustrate cross section views of an anodized substrate undergoing a series of steps for forming an anodized substrate having a white appearance, according to some embodiments.
Figure 2B:
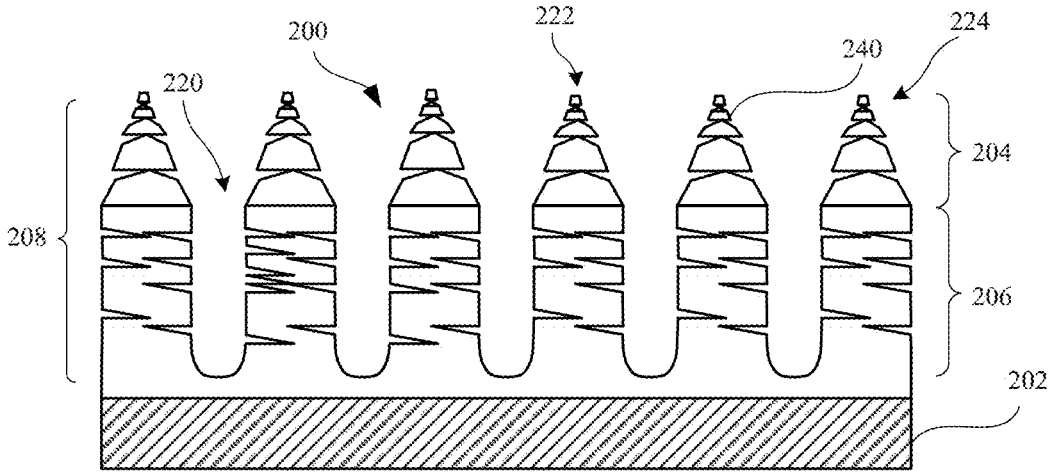
Figure 2C:
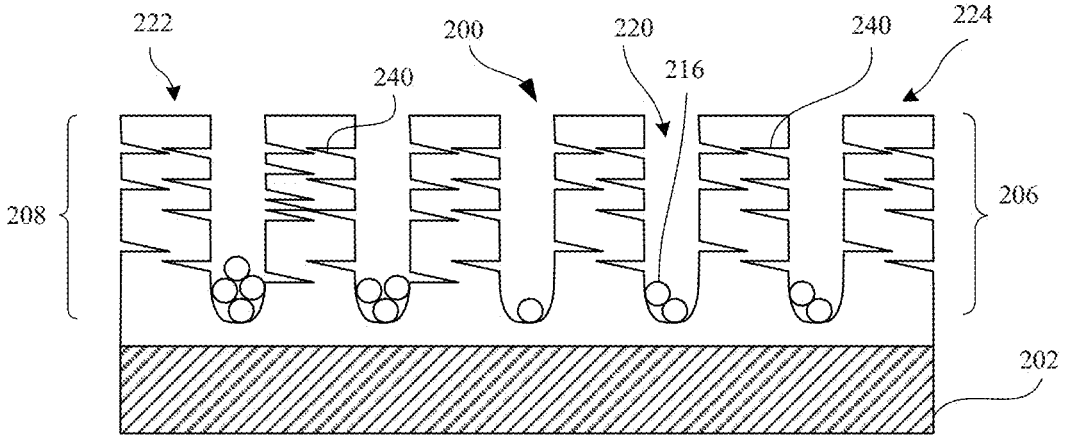

FIGS. 2A-2C illustrate a cross section of the anodized substrate 200 undergoing a sequence of processing steps for providing a white appearance to the anodized substrate 200, in accordance with some embodiments. FIG. 2A illustrates the anodized substrate 200 having a porous anodic layer 208 subsequent to an anodizing process. The porous anodic layer 208 can be formed using an anodizing process whereby a portion of the metal substrate 202 is oxidized and converted to a corresponding metal oxide. Pores 220 are formed throughout the porous anodic layer 208. FIG. 2A further shows a non-porous barrier portion 210 (i.e., does not include pores), which is formed during the anodizing process. In general, pores 220 are elongated voids that are formed within the metal oxide 224 during the anodizing process. Pores 220 are defined by pore walls 212 and a top surface 222 of the porous anodic layer 208.

FIG. 2B illustrates an anodized substrate 200 subsequent to performing a whitening process, in accordance with some embodiments. The whitening process generally includes forming nanometer-scale fissures 240 within pore walls 212 of the pores 220. In some embodiments, fissures 240 are formed by exposing porous anodic layer 208 to an etching solution. The etching solution etches away some of the metal oxide 224 at the pore walls 212, thereby thinning pore walls 212, particularly at the outermost regions of the porous anodic layer 208. In some embodiments, fissures 240 can correspond to voided regions within pore walls 212, and which have surfaces generally oriented orthogonal with respect to the top surface 222. In other embodiments, fissures 240 can refer to a cleave or split between two adjacent portions of the pore wall 212 such that a depression or division is formed between the two adjacent portions of the pore wall 212. Because of their non-parallel orientation with respect to the top surface 222, fissures 240 can diffusely reflect light incident the top surface 222, thereby imparting a white appearance to the anodized substrate 200. The whitening aspects of fissures 240 will be discussed in detail below with reference to FIG. 4. In addition to forming fissures 240, however, the etching process can also cause pore walls 212 at outer regions of anodic layer 208 to become tapered and fragmented—referred to as fragmented portion 204—which can compromise the structural integrity of anodic layer 208. In particular, the fragmented portion 204 can become highly porous and very susceptible to cracking and breakage.

To address this aspect, in some embodiments, the fragmented portion 204 is removed. FIG. 2C illustrates an anodized substrate 200 subsequent to a process for removing the fragmented portion 204 such that the fissured portion 206 is left behind. Fissured portion 206 still includes fissures 240 such that the anodic layer 208 retains its white appearance without a structurally unsound top surface 222. This removal process can be carried out using, for example, a finishing process, such as a polishing, lapping, or buffing process, which is described in detail below with reference to FIG. 7. In some embodiments, the finishing process causes metal oxide particles 216, corresponding to displaced material from metal oxide 224, to be forced within pores 220 and settle at bottom portions 230 of the pores 220. Particles 216 can also diffract light and add a white appearance to anodic layer 208.

Figure 3:
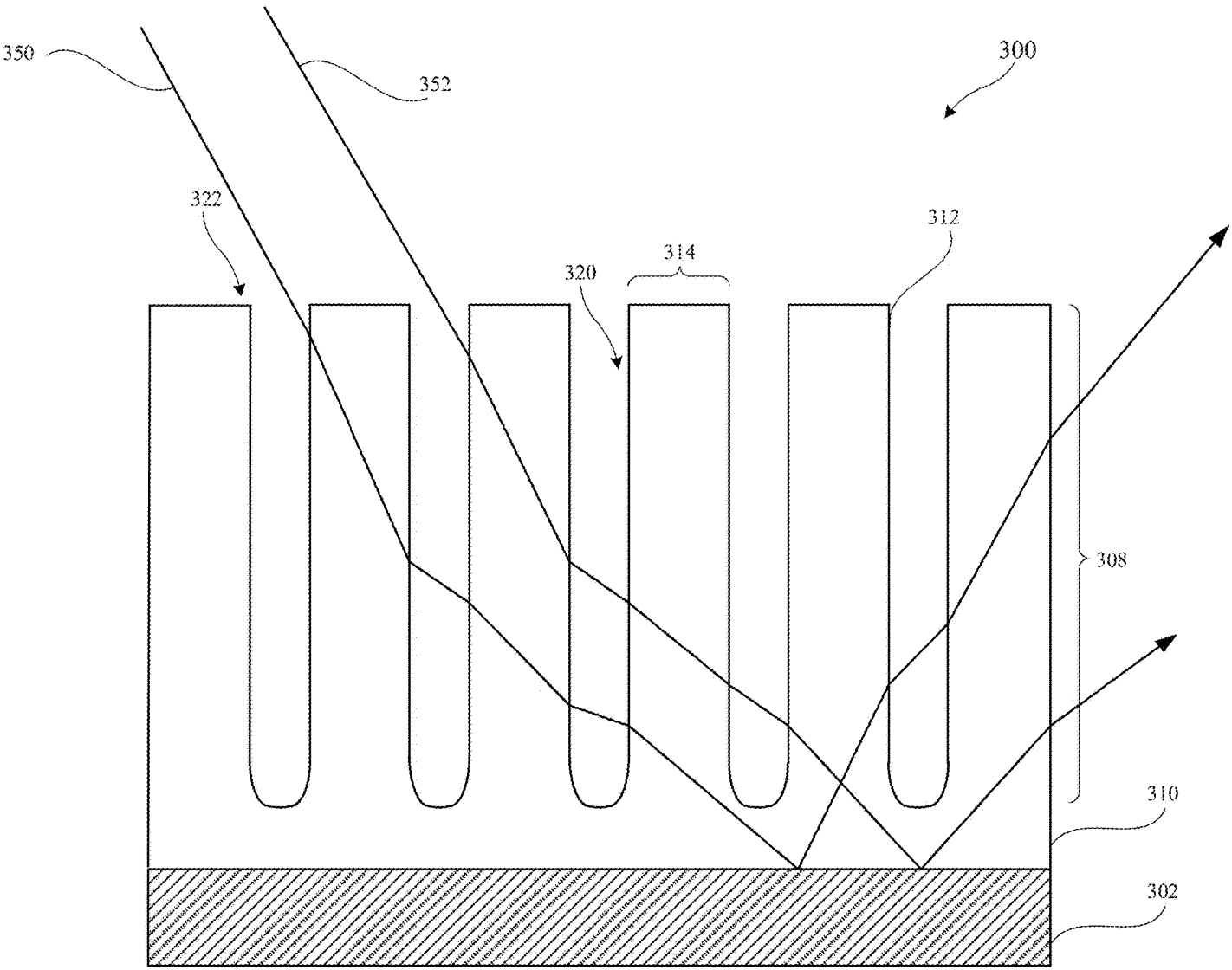
FIG. 3 illustrates a cross section view of an anodized substrate prior to forming fissures in an anodized porous layer, according to some embodiments.

FIG. 3 illustrates a cross section view of the anodized substrate 300 prior to implementing the above-described whitening process. Anodized substrate 300 includes porous anodic layer 308, which is positioned over the metal substrate 302. The metal substrate 302 can include any of a number of suitable materials. In some embodiments, metal substrate 302 includes pure aluminum or aluminum alloy. In other embodiments, metal substrate 302 includes pure titanium or a titanium-based alloy. Porous anodic layer 308 can include a number of pores 320 which are arranged longitudinally along the length of the porous anodic layer 308. In some embodiments, the pores 320 may be arranged substantially parallel to each other. In one example, the porous anodic layer may have a thickness between about 5 micrometers to about 20 micrometers. In other examples, the porous anodic layer 308 can have a thickness between about 8 micrometers to about 15 micrometers. The thickness of metal substrate 302 can vary depending on particular applications. Generally, the metal substrate 302 is thicker than porous anodic layer 308. However, in some embodiments, the metal substrate 302 is thinner than porous anodic layer 308. Thus, FIG. 3 is not necessarily drawn to scale.

Pores 320 of the porous anodic layer 308 can be formed by exposing metal substrate 302 to an electrolytic oxidative process in anodic bath solution—generally referred to as anodizing. For most anodizing processes, pores 320 are generally substantially parallel in orientation with respect to each other and substantially perpendicular with respect to the top surface 322 of the porous anodic layer 308. The width (or diameter) and shape of each of pores 320 can vary depending on the type of anodizing process used. In general, the width of the pores 320 is in the scale of nanometers. In some embodiments, such as type II anodizing processes, a sulfuric acid is used. For typical type II anodizing, the width of each of pores 320 typically ranges between about 10 nanometer and 20 nanometers. In other embodiments, the anodizing process is performed in phosphoric acid and/or oxalic acid solution, which can result in anodic layer 308 having wider pores (e.g., between about 100 nm to about 500 nm in width) compared to anodizing in sulfuric acid solution (e.g., type II anodizing). The voltage used during the anodization process will vary depending on the type of anodizing solution and other process parameters. In particular embodiments, an applied voltage of greater than 50 volts is used. In one embodiment, a phosphoric acid solution is used and a voltage of about 150 volts is used. It should be noted that pores 320 that are too wide could impact the structural integrity of the porous anodic layer 308. In a particular embodiment, a phosphoric acid anodizing process using a voltage of between about 80 volts and 100 volts is used to form a porous anodic layer 308 having a target thickness of about 10 micrometers. In some embodiments, an oxalic acid anodizing process using a voltage of between about 20 volts to about 120 volts is used.

FIG. 3 illustrates that pores 320 are separated and defined by wall segments 314 of the pore walls 312 of the porous anodic layer 308. Wall segments 314 are made of metal oxide material. FIG. 3 shows that a non-porous barrier portion 310 can be positioned between the metal substrate 302 and the porous anodic layer 308 according to some embodiments. The non-porous barrier portion 310 refers to an oxidized layer of the metal substrate 302, which does not include pores 320.

In many applications, porous anodic layer 308 is substantially transparent to the underlying metal substrate 302. That is, a majority of light incident on the porous anodic layer 308 passes through the porous anodic layer 308 and reaches the underlying metal substrate 302. To illustrate, light ray 350 entering the top surface 322 of the porous anodic layer 308 can pass through porous anodic layer 308 and be reflected or refracted by the top surface of the metal substrate 302. Light ray 352 entering another portion of the top surface 322 of the porous anodic layer 308 can pass through the porous anodic layer 308 and be reflected or refracted at a different angle by the top surface of the metal substrate 302.

Figure 4:
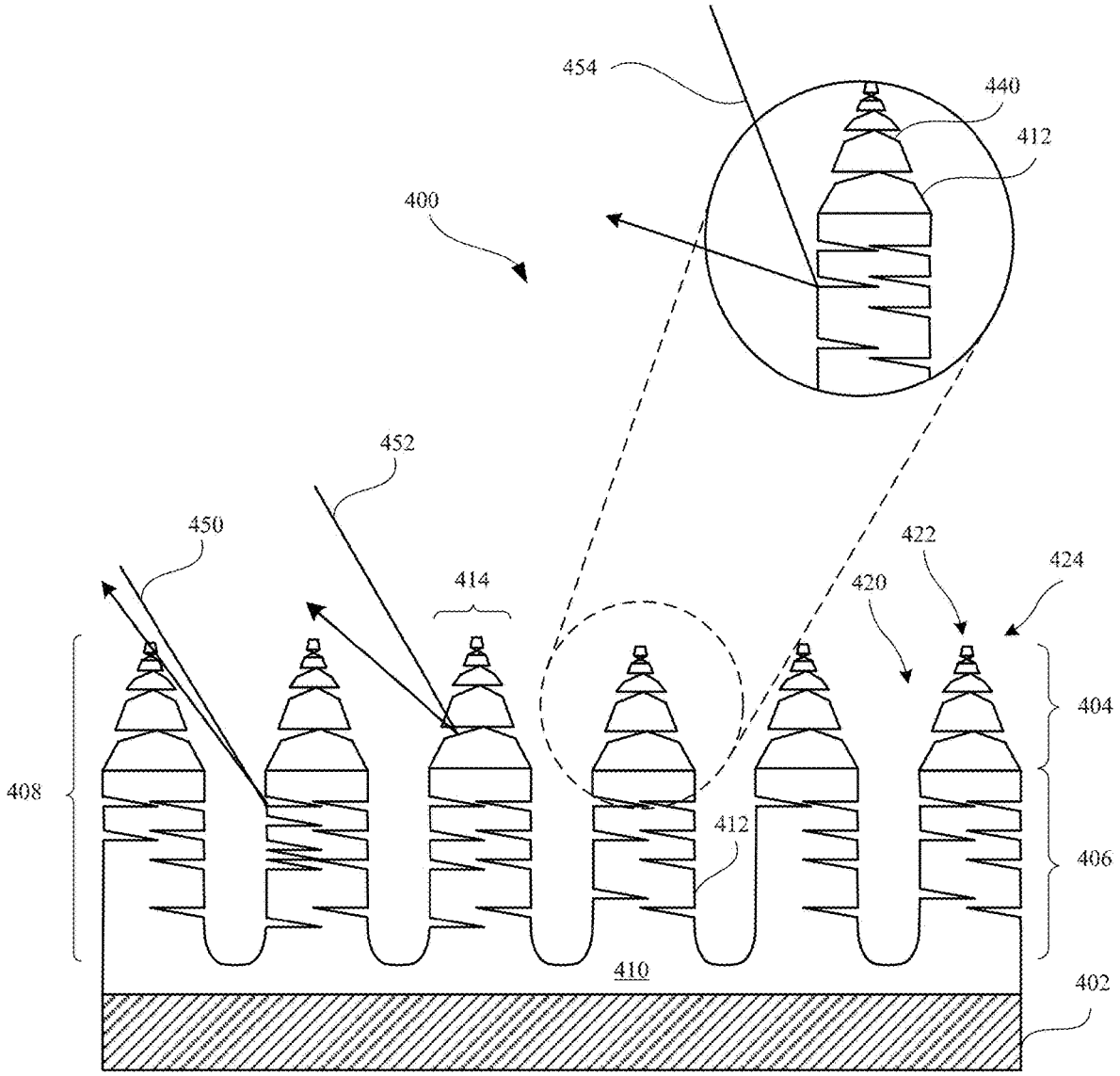
FIG. 4 illustrates a cross section view of the anodized substrate prior to an outer portion of the anodized porous layer being removed, according to some embodiments.

FIG. 4 illustrates a cross section view of the anodized substrate 400 subsequent to a procedure where a number of fissures 440 are formed within the walls 412 that define the pores 420 as a result of an etching process. The specific etching process which will be described in more detail with reference to FIGS. 6-7. As described above, the etching process can create a fragmented portion 404 and a fissured portion 406. FIG. 4 illustrates that the fragmented portion 404 is positioned above the fissured portion 406. In other words, the fragmented portion 404 is positioned closer to the top surface 422 of the porous anodic layer 408 to provide the porous anodic layer 408 with a substantially white appearance.

Generally, the fragmented portion 404 can refer to the section of the porous anodic layer 408 where the outer regions of the pore walls 412 are removed such as to form a generally tapered or pointed shape of the pore walls 412. The shape of the substantially parallel structure of the pores 420 of the porous anodic layer 408 can be significantly changed as a result of the etching process. In other words, a section of the fragmented portion 404 having a generally tapered shape may have previously been a generally linear or parallel structure which was perpendicular to the metal substrate 402 and non-porous portion prior to the etching process. The fissured portion 406 can refer to the section of the porous anodic layer 408 where the outer regions of the pore walls 412 are not thinned or reduced to such an extent as to form a tapered shape of the pores 420. FIG. 4 is illustrative that although fissures 440 may be formed within the walls 412 of the fissured portion 406, the substantially parallel structure of the pores 420 of the fissured portion 406 prior to the etching process remains unaffected. Fissures 440 can generally refer to a portion of the pore wall 412 having an absence of oxide material or hollowed out material, such as a craze, a groove, or a furrow according to some embodiments. In other embodiments, fissures 440 can refer to portions of the pore wall 412 having cracks or clefts formed within the pore wall 412 as a result of the etching process. In other embodiments, fissures 440 can refer to two adjacent portions of the pore wall 412 having a cleave or a split formed between the two adjacent portions of the pore wall 412 such that a depression or division is formed between the two adjacent portions.

During the etching process, the pore walls 412 can become reduced as a result of exposure to the etching solution such that a thinning effect is more prevalent at the pore walls 412 closer towards the top surface 422. By etching away at the pore walls 412 closer to the top surface 422, the fragmented portion 404 can form pores 420 having a generally tapered shape such that the average width of a pore 420 at the top surface 422 is wider than an average width of a portion of the same pore 420 that is below the top surface 422. In some embodiments, the etching solution etches away some of the metal oxide 424 around pore walls 412, thereby thinning pore walls 412, particular at outer regions of porous anodic layer 408. As shown in FIG. 4, this creates fissures 440 within anodic layer 408. Since fissures 440 are generally oriented orthogonally with respect to the top surface 422, these fissures 440 can diffusely reflect light incident at the top surface 422, thereby imparting a white appearance to anodized substrate 400. In addition to forming fissures 440, however, the etching process can also cause pore walls 412 at outer regions of anodic layer 408 to become tapered and fragmented—referred to as fragmented portion 404—which can compromise the structural integrity of anodic layer 408. In particular, fragmented portion 404 can become highly porous and very susceptible to cracking. The fissures 440 can be included in a regular or irregular pattern within the walls 412. In some examples, the fissures 440 can have a generally triangular, linear, rectangular shape, or the like. According to some embodiments, depending upon the specific parameters of the etching solution used, the fissures 440 can be formed within only a portion of the length of the pore wall 412. In other embodiments, the fissures 440 can be formed along the entire length of the pore wall 412. FIG. 4 shows that each pore 420 can be separated from another pore 420 via a wall segment 414 of the porous anodic layer 408. In some examples, the fissures 440 of the pore walls 412 can be nanometer-scale sized. For example, the fissures 440 may have a length with a range between 1 nanometer and 30 nanometers according to some embodiments. According to other embodiments, the length of each of the fissures 440 can have a range between 5 nanometers and 20 nanometers. In other examples, the fissuring of the pore walls 412 may be nanometric-scale relative to the pores 420 of the porous anodic layer 408, where the pores 420 can be macro-scale sized. In other words, the size of each of the fissures 440 can be substantially smaller than the size of the pores 420.

FIG. 4 shows that the non-porous barrier portion 410 can be unaffected by the etching process, such that the non-porous barrier portion 410 remains positioned between the metal substrate 402 and the porous anodic layer 408 according to some embodiments. In some embodiments, the thickness of the non-porous barrier portion 410 may be unaffected by the etching process.

FIG. 4 illustrates that the formed fissures 440 may be more heavily concentrated across the pore walls 412 of the fragmented portion 404 compared to the fissures 440 formed within the pore walls 412 of the fissured portion 406. According to one example, a first section of a pore wall 412 of the fissured portion 406 may have a fewer number or a reduced concentration of fissures 440 relative to a different, second section of the same pore wall 412 of the fragmented portion 404. For example, a first section of a pore wall 412 can include four fissures 440, while a second section of the same wall of the pore 420 can include a single fissure 440. A higher concentration of fissures 440 may be present at sections of the pore walls 412 that are closer to the top surface 422, which may be a result of the fragmented portion 404 having increased exposure to the etching solution. As a result, the fragmented portion 404 can include a relatively high number of fissures 440 as a result of the etching solution etching away at the outer regions of the pore walls 412 and thinning the pore walls 412. Although in some instances, it may be possible for the first section of the pore wall 412 of the fissured portion 406 to have the same number (or concentration) of fissures 440 or a greater number of fissures 440 (or concentration of) relative to a second section of the same pore wall 412 of the fragmented portion 404.

According to some embodiments, it may be preferable to intentionally remove a portion of at least one of the fragmented portion 404 or the fissured portion 406 in order to increase the structural rigidity of the porous anodic layer 408. As discussed, the presence of the number of fissures 440 formed within the pore walls 412 of the porous anodic layer 408 may decrease the structural rigidity of the porous anodic layer 408. In some embodiments, it may be preferable to intentionally remove portions of the porous anodic layer 408 having fissures 440 (either concurrently or subsequent) with the etching procedure so as to reduce the structural frailty of the anodized substrate 400.

FIG. 4 illustrates that the fissures 440 provide a light scattering medium that diffusely reflects a number of visible wavelengths of light incident on the top surface 422 of the porous anodic layer 408 such that light ray 450 is scattered by the fissures 440 before reaching the metal substrate 402. As a result, by diffusely scattering visible light wavelengths, the top surface 422 can have a substantially white appearance. FIG. 4 illustrates how another light ray 452 is scattered by the fissures 440 at a different angle than the light ray 450. Another light ray 454 is illustrated as being scattered by the fissures 440 at a different angle than the light rays 450, 452. In this manner, the fissures 440 can act as a light scattering medium so as to provide a white appearance to the porous anodic layer 408 even after the fragmented portion 404 is removed.

In some embodiments, the pores 420 of the porous anodic layer 408 can be optionally sealed using a sealing process. Sealing closes the pores 420 such that any oxidized fragments of the fragmented portion 404 or the fissured portion 406 are retained within the porous anodic layer 408. In one embodiment, the sealing process includes hydrothermal sealing of the anodic oxide, which can be used for sealing the porous anodic layer 408 and exploits the swelling of amorphous aluminum oxide as it is hydrated when immersed in hot aqueous solutions (e.g., greater than 80° C.) or when it is exposed to steam. In one embodiment, the porous anodic layer 408 is exposed to a 5 g/l solution of nickel acetate at a temperature of 97° C. for a duration of 25 minutes.

Figure 5:
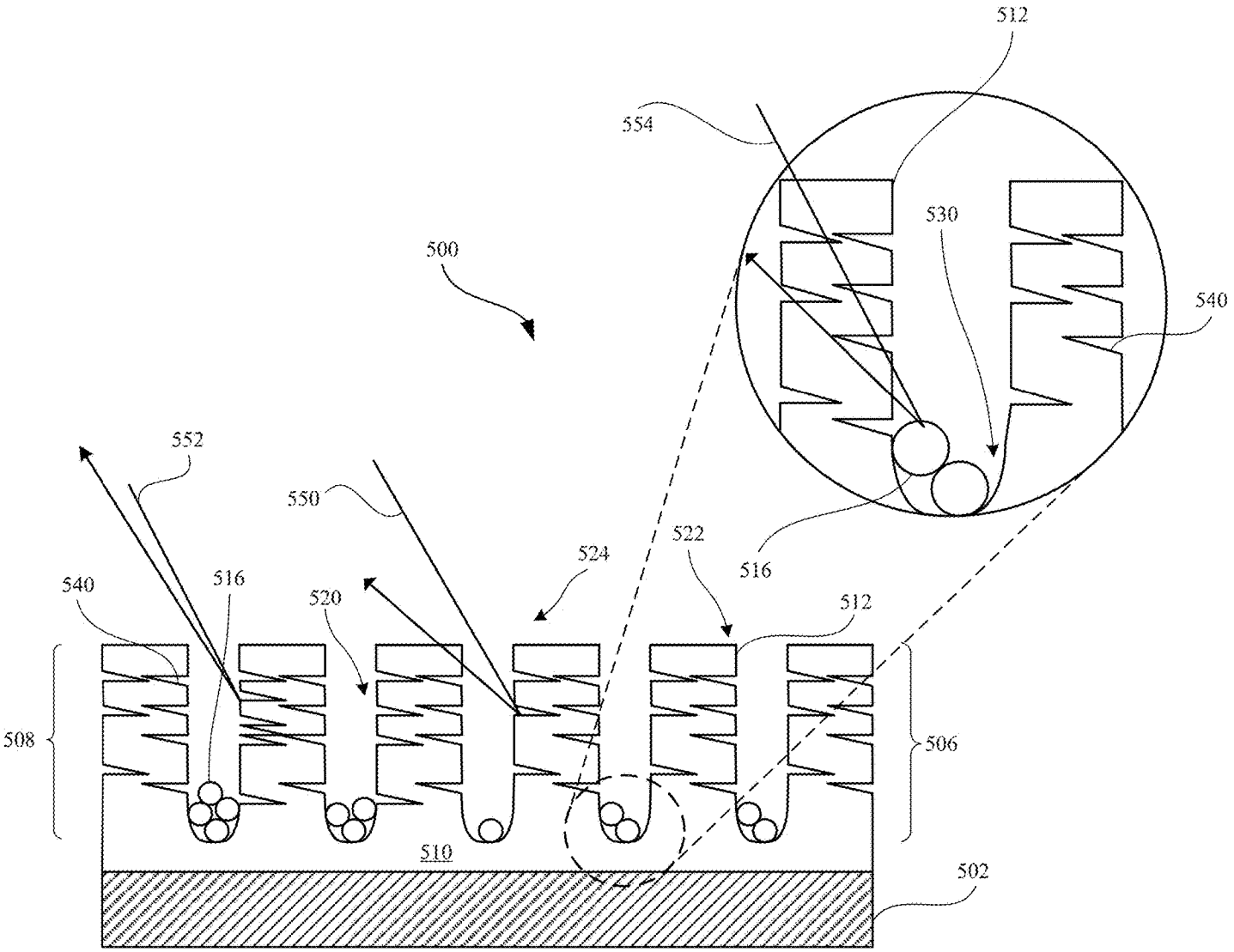
FIG. 5 illustrates a cross section view of the anodized substrate subsequent to an outer portion of the anodized porous layer being removed, according to some embodiments.

FIG. 5 illustrates a cross section view of an anodized substrate 500 subsequent to removing an outer portion of the porous anodic layer 408 or removing the entire fragmented portion (e.g., ref 404, FIG. 4) according to some embodiments. In other embodiments, only a portion of the fragmented portion 404 is removed such that a portion of the fragmented portion 404 continues to remain following the procedure. While forming fissures 440 within the porous anodic layer 408 may be induced to cause the porous anodic layer 408 to have a white appearance, the etching process may induce fragmentation and physical damage to the pore walls 412 as indicated by the fragmented portion. Accordingly, a technique is provided to reduce the physical instability of the porous anodic layer 408 by removing a portion of the fragmented portion 404 such that a more stable anodized substrate can be provided while still retaining some of the fissures 440 in order to continue to provide a white appearance of the porous anodic layer 408. As a result, FIG. 5 illustrates that although the fragmented portion 404 is removed, fissures 540 still remain in the pore walls 512 of the porous anodic layer 508. As such, the anodized substrate 500 may still be enabled to provide a substantially white appearance while having an increased structural rigidity subsequent to the removal process.

In some embodiments, a portion of the fragmented portion 404 that is removed can range from a length of between 1 micrometer to 20 micrometers. In other embodiments, the portion of the fragmented portion 404 that is removed can range from a length between 5 micrometers and 15 micrometers. In other embodiments, the portion of the fragmented portion 404 that is removed can range from a length between 10 micrometers and 15 micrometers. In other embodiments, the portion of the fragmented portion 404 that is removed can range from a length between 3 micrometers and 5 micrometers. FIG. 5 illustrates that removing the entire fragmented portion 404 reveals the fissured portion 506 such that an exterior surface of the fissured portion 506 can be referred to as the top surface 522 of the porous anodic layer 508. In other words, when viewing the porous anodic layer 508 from a top view, only the fissured portion 506 will be visibly apparent.

According to some embodiments, in the remaining porous anodic layer 508, there can be a greater concentration of fissures 540 formed within the walls 512 of the pores 520 towards the top surface 522 of the porous anodic layer 508 than towards the lower portion of the porous anodic layer 508. As such, because the inner or lower portion of the porous anodic layer 508 has fewer fissures 540, the lower portion of the porous anodic layer 508 can also be considered more structurally sound or rigid proximate than the top surface 522 of the porous anodic layer 508. For instance, the lower portion of the porous anodic layer 508 can exhibit higher strength and hardness, as may be evaluated through techniques such as nano-indentation.

FIG. 5 illustrates a cross section view of an anodized substrate 500 having an porous anodic layer 508 according to some of the embodiments described herein. FIG. 5 illustrates a metal substrate 502 and a porous anodic layer 508 that is formed by oxidizing a portion of the metal substrate 502. The porous anodic layer 508 can be composed from metal oxide 524 formed from the anodization process. As shown in FIG. 5, the border between the metal substrate 502 and the porous anodic layer 508 may be substantially regular or of uniform thickness according to some embodiments. In other embodiments, the border between the metal substrate 502 and the porous anodic layer 508 may be substantially irregular or of non-uniform thickness.

Even after the fragmented portion 404 is removed, FIG. 5 illustrates that the fissures 540 of the fissured portion 506 can continue to provide a light scattering medium that diffusely reflects substantially all visible wavelengths of light incident on the top surface 522 of the porous anodic layer 508 such that the top surface 522 has a substantially white appearance. FIG. 5 illustrates how a light ray 550 entering from the top surface 522 of the porous anodic layer 508 is diffusely scattered by the fissures 540. FIG. 5 illustrates how another light ray 552 entering from the top surface 522 of the porous anodic layer 508 is diffusely scattered by the fissures 540 at a different angle. In this way, the fissures 540 can act as a light scattering medium so as to provide a white appearance to the porous anodic layer 508 even after the fragmented portion 404 is removed. In other words, the fissures 540 of either the fragmented portion 404 or the fissured portion 506 can provide a light scattering medium that diffusely reflects substantially all visible wavelengths of light incident that are emitted onto the top surface 522 of the porous anodic layer 508.

FIG. 5 further illustrates that subsequent to removing the fragmented portion 404, the fragmented metal oxide particles or residue 516 that are formed as a result of the removal step, can be displaced within the walls 512 of the pores 520. In some examples, the displaced metal oxide particles 516 can reside within the outer extremities of the pores 520. In other examples, the displaced metal oxide particles 516 can fill a minority, majority, or an entirety of the pore 520. In other examples, there can be an absence of metal oxide particles 516 displaced within the pores 520 subsequent to the procedure. In some embodiments, the metal oxide particles 516 may impart a substantially white appearance to the porous anodic layer 508 since they can diffusely reflect substantially all wavelengths of visible light. For example, a light ray 554 can enter the pores 520 and reflect off of the metal oxide particles 516. The particles 516 positioned at the bottom portions 530 of the pores 520 can act as a light scattering medium for diffusing incident visible light entering from the top surface 522 thus giving the bottom portions 530 of the pores 520 an opaque and white appearance. In addition to contributing to light scattering, the displaced metal oxide particles 516 can enhance or improve the structural rigidity of the porous anodic layer 508 as well as seal the pores 520 of the porous anodic layer 508. The metal oxide particles 516 can provide additional material (e.g., oxide and hydroxide) to plug the pore openings such as to raise the material density of the porous anodic layer 508 to compensate for fissures 440 which were previously removed. The metal oxide particles 516 can also be physically or mechanically wedged into the pores 520, and can additionally be entrapped during the swelling of the pore walls 512 during a hydrothermal sealing process. As a result, the metal oxide particles 516 can also swell in volume during the hydrothermal sealing process, as a result of hydration, such that the metal oxide particles 516 become permanently fused as part of the pore walls 512.

Although FIG. 5 illustrates the metal oxide particles 516 as being generally spherical in shape, the particles 516 may also include a combination of a spherical, rectangular, triangular shape, and the like. In addition, the metal oxide particles may be generally macro-scale sized or nano-scale sized.

The terms outer portion of the porous anodic layer 508, a portion of the fragmented portion 404, and the entire fragmented portion 404 can be used interchangeably while referring to removing the outer portion of the porous anodic layer 508.

Subsequent to the step of removing the fragmented portion 404 of the porous anodic layer 508, the pores 520 can be optionally sealed using a sealing process. In other embodiments, the step of removing the fragmented portion by a lapping or sealing process can itself mechanically seal a portion of the pore openings via plugging the pores 520 with fragments or particles 516 of metal oxide as well as possibly polishing media. In some embodiments, supplementary sealing can enhance the sealing of the pores 520. Sealing closes the pores 520 such that pores 520 can retain the metal oxide particles 516. The sealing process can swell the pore walls 512 of porous anodic layer 508 and close the pore openings of the pores 520. Any suitable sealing process can be used. In one embodiment, the sealing process includes exposing the anodized substrate 500 to a solution containing hot water with nickel acetate. In some embodiments, the sealing process forces some of metal oxide particles 516 to be displaced from top portions of pores 520. As shown, in FIG. 5, portions of metal oxide particles 516 at top portions of pores 520 have been displaced during the sealing process to reside within the bottom portions 530 of pores 520. Thus, portions of metal oxide particles 516 still remain within the pores 520 even after the sealing process. Indeed, metal oxide particles 516 are themselves susceptible to swelling during hydrothermal sealing. Accordingly, subjecting the porous anodic layer 508 to a hydrothermal sealing process can further reinforce the structural rigidity of the porous anodic layer 508, reinforce the sealing of the pores 520, and reinforce the physical retention of metal oxide particles 516 within the pores 520. A hydrothermal sealing process can refer to a process in which amorphous metal oxides such as aluminum oxide are exposed to a hot aqueous solution or steam, resulting in the formation of hydroxides or oxy-hydroxides of lower density (and higher volume) than the original oxide. This process can be used for swelling the pore walls 512 in order to plug the pores 520. One example of the sealing process includes immersing the porous anodic layer 508 in a hot aqueous solution (e.g., greater than 80° C.) or when it is exposed to steam. In one embodiment, the porous anodic layer 508 is exposed to about 5 g/l solution of nickel acetate at a temperature of 97° C. for a duration of 25 minutes.

Figure 6:
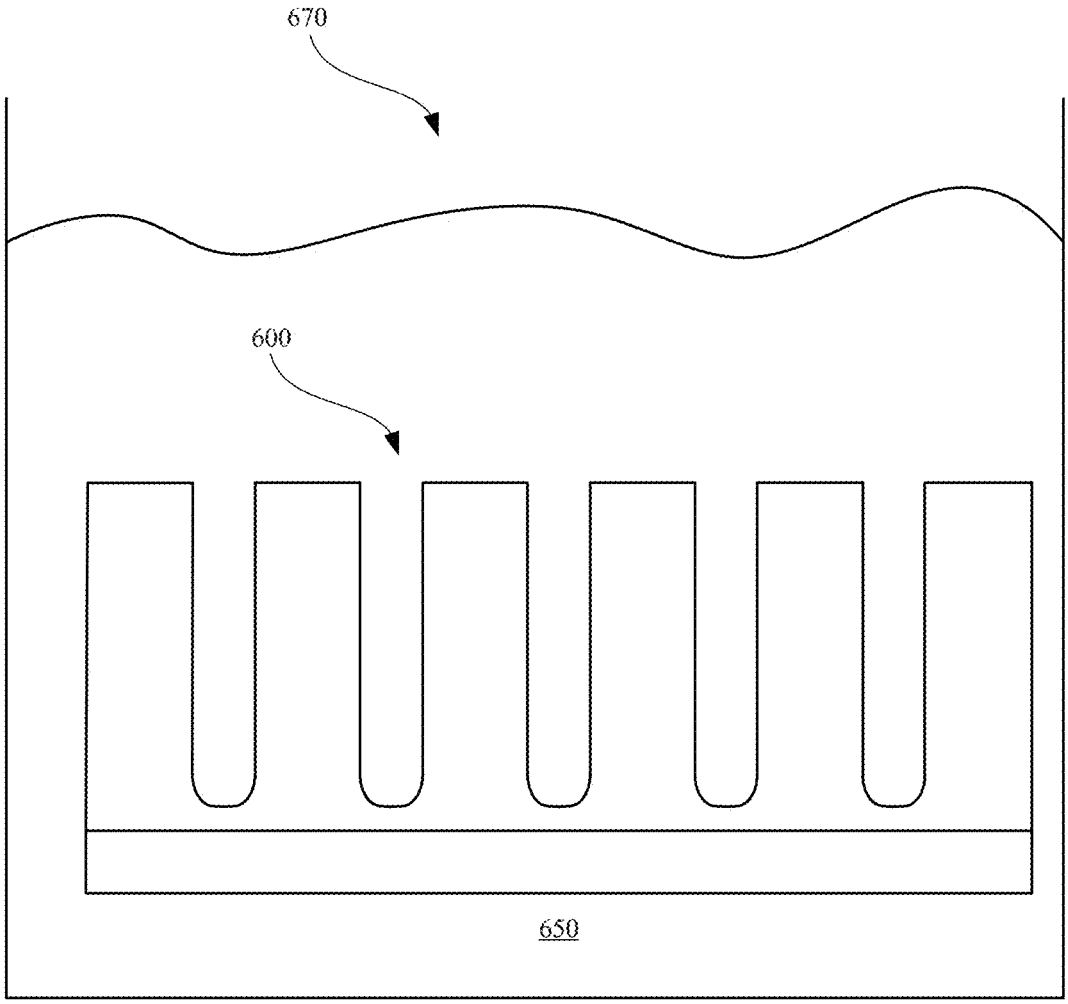
FIG. 6 illustrates an apparatus suitable for forming fissures in the anodized porous layer, according to some embodiments.

FIG. 6 illustrates an exemplary apparatus for forming fissures 240 in the porous anodic layer 208 according to some embodiments. FIG. 6 shows that an anodized substrate 600 is placed in an etching bath or solution 650 in a tank or container 670. The container 670 can hold the etching solution 650, while a portion of the anodized substrate 600 is submerged in the etching solution 650. An etching (e.g., acidic or alkaline etching) is used to create a textured surface or fissures 240 within the porous anodic layer 208 of the anodized substrate 600, which can be retained by the walls 212 of the pores 220. According to some examples, the anodized substrate 600 can be etched through exposure to a $Al_2(SO_4)_3$ solution for 25 minutes at 60° C. In another example, the anodized substrate 600 can be etched through exposure to an alkaline $Na_2CO_3$ solution for 20 minutes at 30° C.

Figure 7:
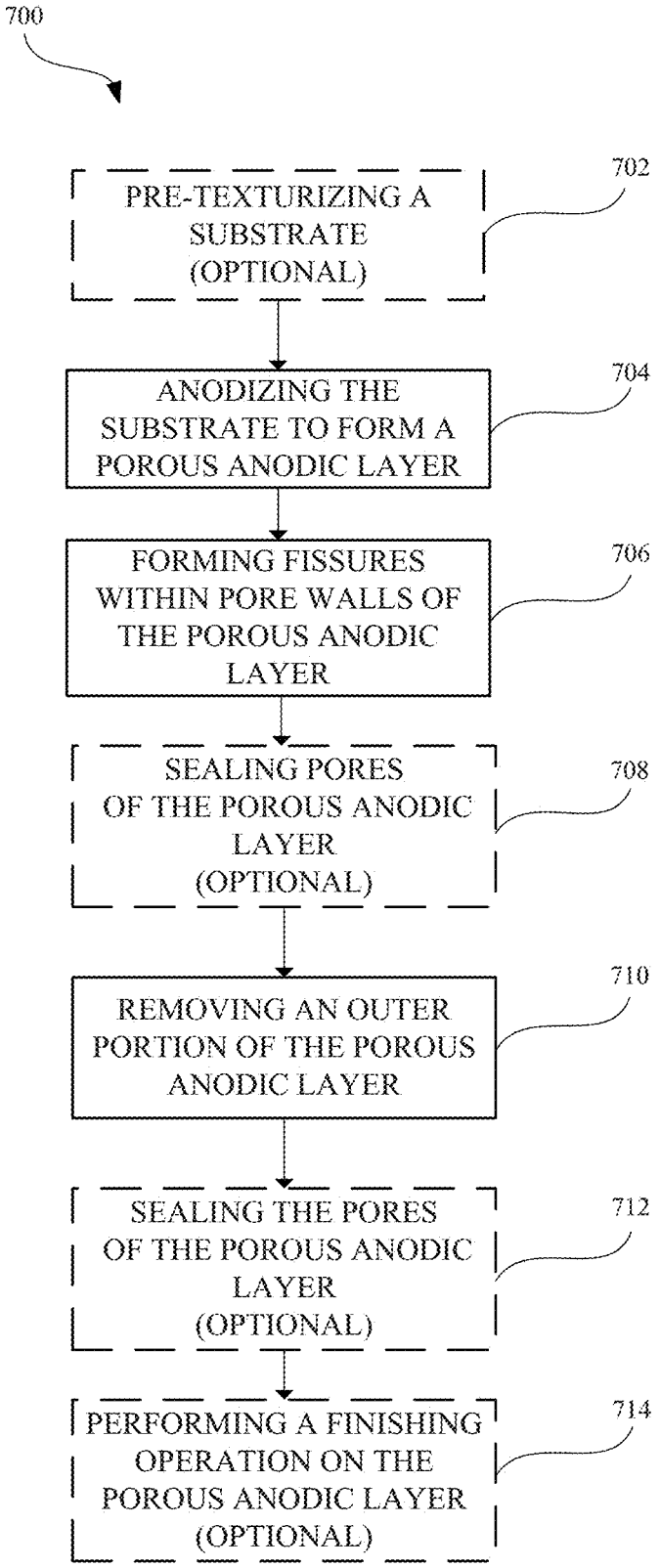
FIG. 7 illustrates a flowchart indicating a process for forming an anodized substrate having a white appearance, according to some embodiments.

FIG. 7 illustrates a process 700 for forming a porous anodic layer 208 having a substantially white appearance according to some embodiments. As shown in FIG. 7, the method 700 can begin at step 702, where a surface pretreatment (or pre-texturizing) is optionally performed on the metal substrate 202. The surface treatment can be a polishing process that creates a mirror polished substrate surface, corresponding to a generally uniform surface profile. In other embodiments, the surface treatment is an etching process that creates a textured surface that can have a matte appearance. In some examples, creating a textured surface can be the result of at least one of blasting, etching, or chemically polishing the surface of the metal substrate 202. Suitable etching processes include an alkaline etch, where the metal substrate 202 is exposed to an alkaline solution (e.g., NaOH) for a predetermined time period for creating a desired texture. Acidic etching solutions (e.g., $NH_4HF_2$) can also be used. Polishing techniques can include chemical polishing, which involves exposing the metal substrate 202 to acidic solution, e.g., sulfuric acid and phosphoric acid solutions. In some embodiments, the polishing includes one or more mechanical polishing processes. In some embodiments, a textured or roughened surface of the metal substrate 202 can be preferable for the purposes of imparting a uniform white appearance to the surface. In some embodiments where a final white or other bright appearance to the porous anodic layer 208 is desired, the metal substrate 202 is preferably polished rather than etched in order to create an underlying light reflective substrate surface. In other embodiments, where a dark color or shade is desired, the metal substrate 202 can be etched in order to purposely create an underlying light trap that traps incoming light. In some embodiments, the textured surface of the metal substrate 202 can also control the structure of the porous anodic layer 208 formed (see step 704) as well as influence the etching process used to form fissures 240 in the porous anodic layer (see step 706).

At step 704, an anodization step is performed on the metal substrate 202. During the anodizing process, a porous anodic layer 208 having a number of pores 220 formed longitudinally throughout the porous anodic layer 208 can be formed. In some embodiments, the anodizing is performed in a sulfuric acid solution, such as a type II anodizing process. In some embodiments, the anodizing is performed in a phosphoric acid or oxalic acid solution, which can form wider pores 220 than sulfuric anodizing processes. During the anodizing process, a porous anodic layer 208 having a porous layer and a non-porous barrier portion 210 can be formed.

At step 706, a number of fissures 240 can be formed within the pore walls 212 of the porous anodic layer 208. In some embodiments, an etching (e.g., acidic or alkaline etching) is used to form the fissures 240 within the pore walls 212. The etching solution can also etch away some of the metal oxide around the pore walls 212, thereby thinning pore walls 212, particularly at the outermost regions of the porous anodic layer 208. Since fissures 240 are generally oriented orthogonally with respect to top surface 222, these fissures 240 can diffusely reflect light incident top surface 222, thereby imparting a white appearance to anodized substrate. In addition to forming fissures 240, however, the etching process can also cause pore walls 212 at outer regions of the porous anodic layer 208 to become tapered and fragmented—referred to as fragmented portion 404—which can compromise the structural integrity of the porous anodic layer 208.

At step 708, pores 220 of the porous anodic layer 208 can be optionally sealed via a sealing process according to some embodiments. In some instances, sealing the pores 220 may be preferable in that sealing closes the pores 220 such that any oxidized fragments of either the fragmented portion 204 or the fissured portion 206 are retained within the porous anodic layer 208. In some instances, the sealant can settle towards the bottom portions 230 of the pores 220 of the fissured portion 206. The sealant may trap displaced oxidized materials of the porous anodic layer 208 between the sealant and the bottom portions 230 of the pores 220. This sealing process hydrates the metal oxide material of the pore walls 212, thereby increasing the structural integrity of the porous anodic layer 208. In general, the sealing process does not, however, remove the light reflecting fissures 240. In one embodiment, the sealing process includes exposing the porous anodic layer 208 to a solution containing hot water with nickel acetate for a period of time (e.g., about 25 minutes).

In other embodiments, sealing the pores 220 prior to the step of removing the outer portion of the porous anodic layer 208 may not be preferable because the sealant may actually prevent displaced metal oxide particles 216 originating from the fragmented portion 204 from being displaced into the pores 220 of the porous anodic layer 208. As detailed with reference to FIG. 5, fragmented metal oxide particles 516 can be formed and displaced as a result of the removal step. In some embodiments, the metal oxide particles 516 may impart a desirable substantially white appearance to the porous anodic layer 508 since they can diffusely reflect substantially all wavelengths of visible light. However, sealing the pores 520 prior to the step of removing the outer portion can prevent the displaced metal oxide particles 516 from being trapped within the pores 520. In some embodiments, the displaced metal oxide particles 516 or residues can contribute to the density of the porous anodic layer 508, e.g., by filling the pores 520 via mechanical packing. The metal oxide particles 516 can be susceptible to swelling, and may also contribute to expanding the pore walls 512 for providing a robust seal for the pores 520.

While forming fissures 240 within the porous anodic layer 208 imparts a white appearance to the porous anodic layer 208, the etching process can cause severe physical damage to the pore walls 212 at external or top portions of the porous anodic layer 208, referred to above as a fragmented portion 204 of the porous anodic layer 208. At step 710, some or the entire fragmented portion 204 of the porous anodic layer 208 can be removed. By removing some or the entire fragmented portion 204, the remaining porous anodic layer 208 has improved structural integrity and is more resistant to breakage and cracking. The pore walls 212 of the remaining portion, i.e., the fissured portion 206, will include fissures 240 created from the etching process. These fissures 240 can provide a light scattering medium that diffusely reflects visible wavelengths of light incident on a top surface 222 of the porous anodic layer 208, thereby providing a white appearance to the porous anodic layer 208 as viewed from a top surface 222 of the porous anodic layer 208. In some embodiments, the removal process includes a finishing process, such as a polishing, lapping and/or buffing process. In some cases, the finishing process can force fragments of metal oxide material from the fragmented portion 204 to displace within the pores 220 of the porous anodic layer 208. These fragments or particles 216 can also serve as light scattering medium for diffracting incoming light.

At step 712, the pores 220 of the porous anodic layer 208 may be optionally sealed using a sealing process e.g., hydrothermal sealing. The sealing process can seal the open pores 220 by hydrating the metal oxide material of the pore walls 212. The sealing process can be important to keep contaminants such as water, dirt and oil out of the pores of the porous anodic layer 208, which can affect the visual appearance of the substrate. In addition, the sealing prevents water from reaching and corroding the underlying metal substrate 202. Furthermore, the sealing process can trap metal oxide fragments or particles 216 displaced into the pores 220 as a result of the step of removing the fragmented portion during step 710. In some embodiments, the pores 220 can be sealed via a similar process used to seal the pores 220 as described in step 708. In some instances, the metal oxide particles 216 can themselves become hydrated and contribute to the robustness of the seal formed during the hydrothermal sealing step in order to boost the structural rigidity of the porous anodic layer 208.

At step 714, a finishing operation (e.g., a surface treatment) can be optionally applied to the porous anodic layer 208 to further adjust surface finish and cosmetics. For example, a polishing or buffing operation can be used to give the top surface 222 of the porous anodic layer 208 a uniform and shiny appearance.

Figure 8A:
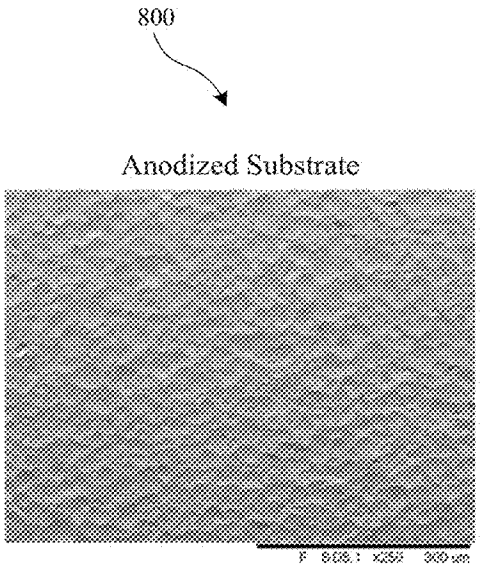
FIGS. 8A-C illustrate exemplary images of a perspective view of the anodized substrate subsequent different steps performed, according to some embodiments described herein.
Figure 8A:
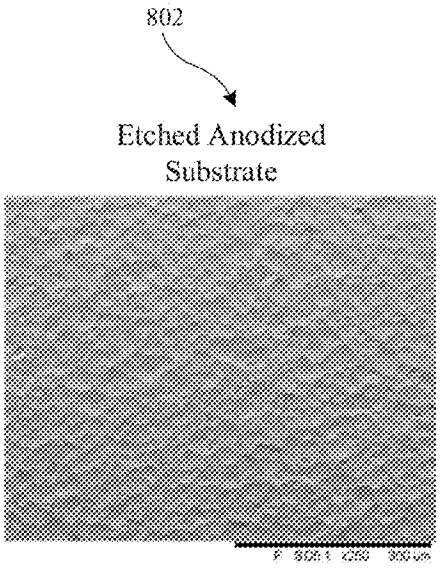
Figure 8A:
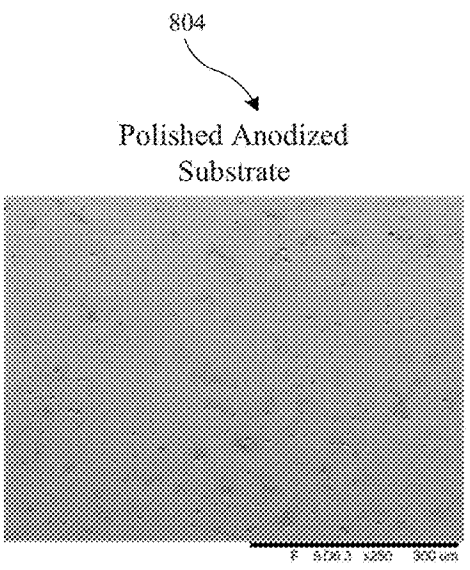
Figure 8A:
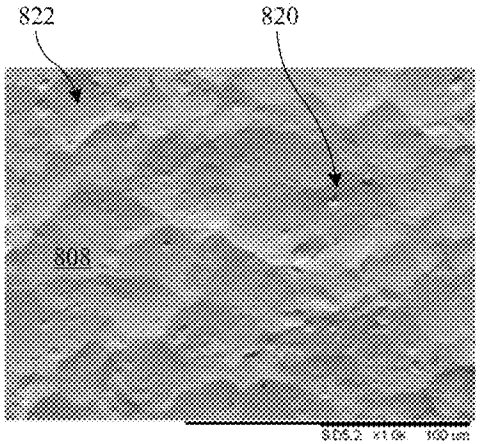
Figure 8B:
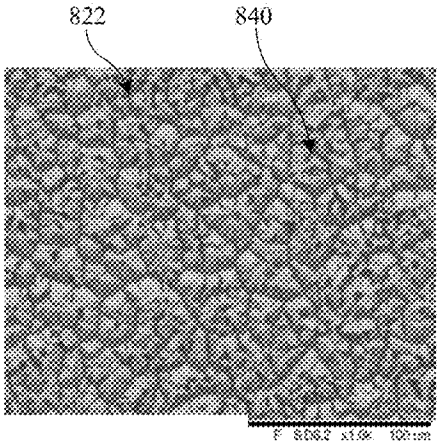
Figure 8C:
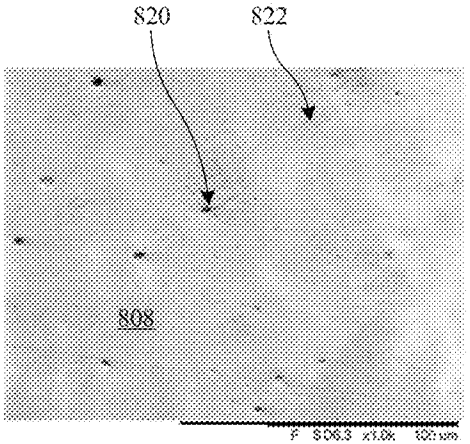

FIGS. 8A-8C illustrate exemplary electron microscopy images of the anodized substrate during different stages of processing the metal substrate. FIG. 8A illustrates a perspective view of the anodized substrate 800 at 250× magnification and a perspective view of the anodized substrate at 1000× magnification. FIG. 8A illustrates a perspective view of the top surface 822 of the anodized substrate 800 including a porous anodic layer 808 prior to imparting a white appearance to the anodized substrate 800. As shown in FIG. 8A, a number of pores 820 are arranged proximate to the top surface 822 of the porous anodic layer 808.

FIG. 8B illustrates a perspective view of an etched anodized substrate 802 at 250× magnification and a perspective view of the etched anodized substrate 802 at 1000× magnification. FIG. 8B illustrates a perspective view of the top surface 822 of the etched anodized substrate 802 including a porous anodic layer 808 subsequent to a step for forming fissures 840 within the walls of the pores. According to one embodiment, a number of fissures 840 can be formed within the walls of each pore during an etching process.

FIG. 8C illustrates a perspective view of a polished anodized substrate 804 at 250× magnification and a perspective view of the polished anodized substrate 804 at 1000× magnification. FIG. 8C illustrates a perspective view of the top surface 822 of the polished anodized substrate 804 including a porous anodic layer 808 subsequent to a step of removing an outer portion or top surface 822 of the porous anodic layer 808 according to some embodiments. In other embodiments, the fragmented portion can be either partially or entirely removed. When the fragmented portion or top surface 822 of the porous anodic layer 808 is removed, the fissured portion becomes exposed as the top surface of the porous anodic layer 808. The porous anodic layer 808 can include pores 820.

According to other embodiments, the polished anodized substrate of FIG. 8C can also be polished or buffed in order to smooth the top surface 822 of the porous anodic layer 808.

Figure 9:
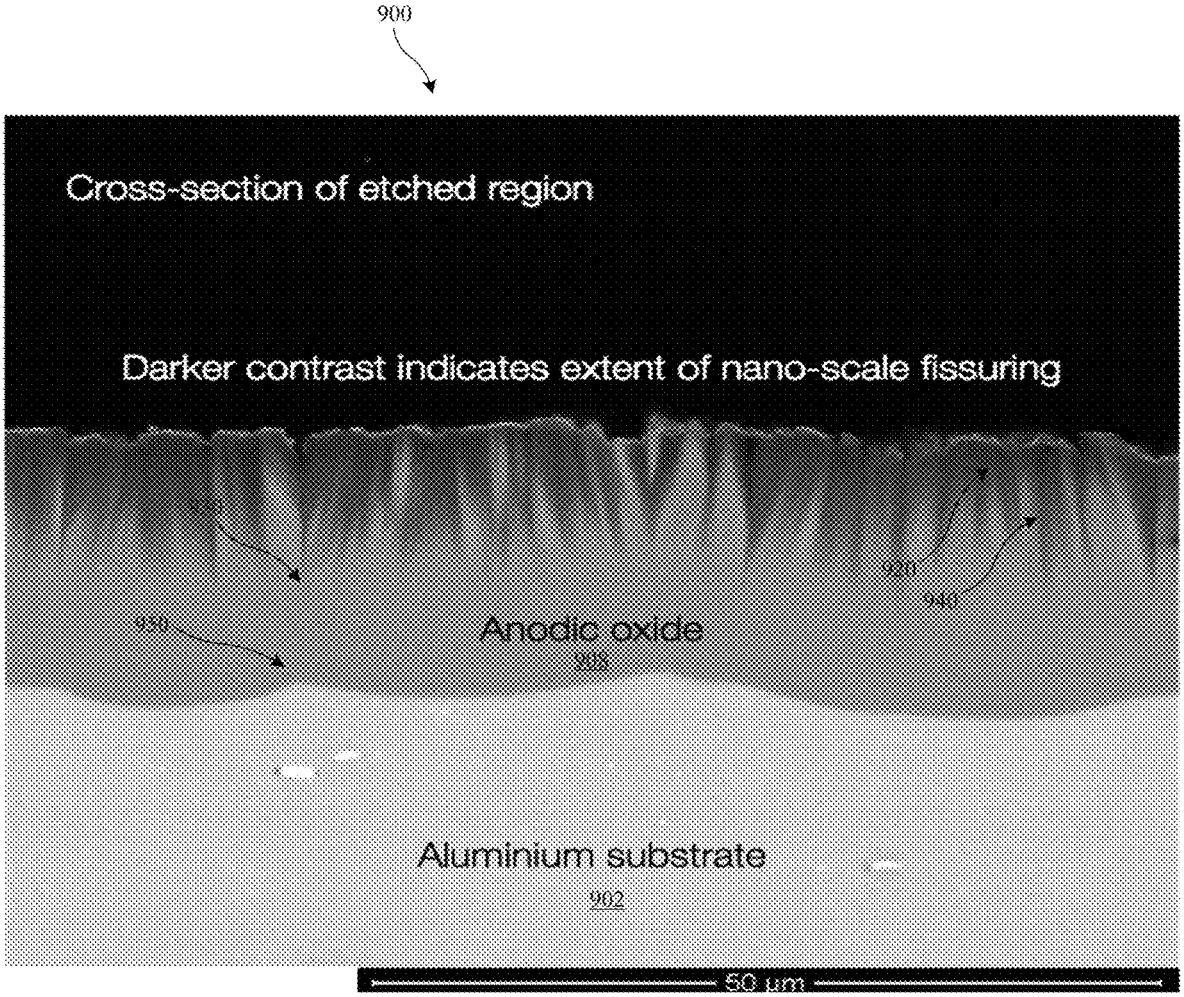
FIG. 9 illustrates an exemplary image of a cross section view of the anodized substrate, according to some embodiments described herein.

FIG. 9 illustrates an electron microscopy image of the anodized substrate 900 including a porous anodic layer 908 at a magnification level of 4000×. In some embodiments, FIG. 9 illustrates the porous anodic layer 908 and the metal substrate 902 subsequent to the step for forming fissures within the pore walls (e.g., etching step). In other embodiments, FIG. 9 illustrates the porous anodic layer 908 subsequent to any of the other aforementioned steps described. FIG. 9 shows that a number of fissures 940 extend within the pore walls, where the pores are arranged longitudinally within the porous anodic layer 908. As shown in FIG. 9, the pores 920 extend longitudinally through only a portion (i.e., not the entirety) of the porous anodic layer 908 such that a cross-section or layer of the porous anodic layer 908 does not include pores. In addition, FIG. 9 illustrates that the fissures 940 formed within the pore walls are more highly concentrated (or numerous) towards the top surface of the porous anodic layer 908. Towards the inner or lower portion of the porous anodic layer 908, the concentration of fissures 940 continues to taper off at a constant or exponential rate. Furthermore, FIG. 9 shows that the metal substrate (e.g., aluminum) 902 can include a varied or non-uniform thickness relative to the border between the porous anodic layer 908 and the substrate. FIG. 9 further illustrates a series of peaks 950 that are disposed on the top surface of the metal substrate 902. The pore 920 formed through the porous anodic layer 908 can correspond with an corresponding peak 950 of the metal substrate 902. For instance, the associated peak 950 of the metal substrate 902 can be formed as a result of increased amounts of oxide particles being displaced onto the surface of the metal substrate 902. According to some embodiments, each pore 920 is formed as a result of an increased number of particles (not illustrated) converging towards the bottom portion of the pores 920. Towards the bottom portion of the pores 920 can be an increased concentration of particles such that the oxidized particles of the pores build up over the metal substrate 902 to form a peak 950. The described pores 920 can be generally broad and shallow in shape compared to pores of typical porous anodic layers.

FIG. 9 further illustrates that the porous anodic layer 908 can include a fragmented portion and a fissured portion (not illustrated). The fragmented portion can be similar to the structure of the fragmented portion (e.g., ref 404 shown in FIG. 4). The fissured portion can be similar to the structure of the fissured portion (e.g., ref 406 shown in FIG. 4). FIG. 9 further illustrates that a series of pores 920 are disposed within the top surface of the porous anodic layer 908 and penetrate through an inside portion of the porous anodic layer 908. FIG. 9 further illustrates a series of peaks 950 that are disposed on the top surface of the fragmented portion. Each pore 920 formed through the porous anodic layer 908 can correspond with a corresponding peak 950 of the metal substrate 902. For instance, the peak 950 of the metal substrate 902 can be formed as a result of increased amounts of oxide particles being displaced onto the surface of the metal substrate 902. According to some embodiments, the peaks 950 can be formed during the anodization process as a result of further penetration of the pores 920 through the inner portion of the porous anodic layer 908 which leads to an increased formation of oxidized particles that form over the metal substrate 902 to form peaks 950.

In some embodiments, FIG. 9 can be representative of the anodized substrate subsequent to a step for forming fissures within the walls of the pores (e.g., etching step). However, the anodized substrate illustrated in FIG. 9 can be representative of the anodized substrate during any particular state, and is not intended to limit the anodized substrate to a particular step.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

What is claimed is:

1. A method for forming an anodized substrate having a white appearance, the method comprising:

forming an anodized coating comprising a mixed metal oxide material formed from and overlaying an aluminum alloy substrate, the anodized coating comprising pore walls and bottom portions that define pores;

etching light-reflecting fissures within the pore walls, the light-reflecting fissures having lengths between 5 nanometers and 20 nanometers and non-parallel orientations with respect to an outermost surface of the anodized coating, the light-reflecting fissures diffusely reflecting light incident on the outermost surface to impart the white appearance, a concentration of the light-reflecting fissures increasing towards the outermost surface; and depositing light-reflecting particles on the bottom portions by fragmenting an outer portion of the anodized coating, wherein a remaining portion of the coating defines at least some of the etched light-reflecting fissures.

2. The method of claim 1, further comprising:

sealing openings of the pore pores subsequent to forming the light-reflecting fissures.

3. The method of claim 1, wherein the light-reflecting fissures are formed by exposing the anodized coating to an etching solution.

4. The method of claim 1, wherein fragmenting the outer portion of the anodized coating reduces a thickness of the anodized coating by between 3 micrometers and 5 micrometers.

5. The method of claim 1, wherein the light-reflecting particles are displaced into the bottom portions by fragmenting the outer portion of the anodized coating.

6. The method of claim 1, wherein the anodized coating comprises mixed metal oxide material, and the light-reflecting particles comprise the mixed metal oxide material.

7. A housing of a portable electronic device having a white appearance, the housing comprising:

an aluminum alloy substrate;

an anodic layer that comprises a mixed metal oxide material formed from and overlaying the aluminum alloy substrate, the anodic layer comprising;

bottom portions and pore walls that define pores, the pore walls further defining light-reflecting fissures having lengths between 5 nanometers and 20 nanometers and non-parallel orientations with respect to an outermost surface of the anodic layer, the light-reflecting fissures diffusely reflecting light incident on the outermost surface to impart the white appearance, a concentration of the light-reflecting fissures increasing towards the outermost surface; and light-reflecting particles that comprise the mixed metal oxide material and are carried by the bottom portions.

8. The housing of claim 7, wherein the light-reflecting fissures are etched into the pore walls.

9. The housing of claim 7, wherein the light-reflecting particles are sealed within the pores by a sealant.

10. The housing of claim 7, wherein the pore walls define fragmented portions with greater concentrations of the light-reflecting fissures than an innermost region of the anodic layer.

11. The housing of claim 7, wherein the light-reflecting particles are formed by fragmenting a portion of the anodic layer.

12. The housing of claim 7, wherein outermost regions of the pore walls are thinner than innermost regions of the pore walls.

13. An enclosure for a portable electronic device having a white appearance, the enclosure comprising:

an aluminum alloy substrate;

an anodized layer that overlays the aluminum alloy substrate and includes a mixed metal oxide material formed from the aluminum alloy substrate, the anodized layer comprising pore walls and bottom portions that define pores having diameters between about 100 nm and about 500 nm, the pore walls defining light-reflecting fissures having lengths between 5 nm and 20 nm that are etched into the pore walls, the light-reflecting fissures diffusely reflect light incident on an outermost surface of the anodized layer to impart the white appearance, a concentration of the light-reflecting fissures increasing towards the outermost surface; and light-reflecting particles that comprise the mixed metal oxide material and are carried by the bottom portions.

14. The enclosure of claim 13, wherein the aluminum alloy substrate is a 6000 series alloy or a 7000 series alloy.

15. The enclosure of claim 13, further comprising:

a sealant that seals openings of the pores such that the light-reflecting particles are sealed within the anodized layer.

16. The enclosure of claim 13, wherein the pore walls define fragmented portions with greater concentrations of the light-reflecting fissures than an innermost region of the anodized layer.

17. The enclosure of claim 13, wherein the light-reflecting particles are formed by fragmenting a portion of the anodized layer.

18. The enclosure of claim 7, wherein the pores have diameters between about 100 nm and about 500 nm.

19. The enclosure of claim 13, wherein the light-reflecting fissures have non-parallel orientations with respect to the outermost surface.

* * * * *